US005918749A

United States Patent [19]

Pille et al.

[11] Patent Number: 5,918,749

[45] Date of Patent: Jul. 6, 1999

[54] DISHWASHER RACK ACCESSORY

[75] Inventors: Charles W. Pille, Newton, Iowa; Rodney M. Welch, Jackson, Tenn.

[73] Assignee: Maytag Corporation, Newton, Iowa

[21] Appl. No.: 08/899,916

[22] Filed: Jul. 24, 1997

[51] Int. Cl.[6] ..... A47F 5/00

[52] U.S. Cl. ..... 211/41.9; 211/41.8; 248/316.7

[58] Field of Search ..... 211/70.7, 41.9, 211/41.8; 248/316.7, 37.3, 37.6

[56] References Cited

U.S. PATENT DOCUMENTS

| | | | |
|---|---|---|---|
| 370,942 | 10/1887 | Hanington | 248/37.6 |
| 755,832 | 3/1904 | Anderson . | |
| 2,523,785 | 9/1950 | Sereno | 248/316.7 X |
| 2,708,037 | 5/1955 | Planeta | 211/74 |
| 2,710,617 | 6/1955 | James et al. | 134/183 |
| 3,289,854 | 12/1966 | Kauffman | 211/41 |
| 3,451,556 | 6/1969 | Macoicz | 211/41 |
| 4,388,967 | 6/1983 | Breese | 248/316.7 X |
| 4,498,594 | 2/1985 | Elder | 211/181 |
| 4,635,799 | 1/1987 | Penner | 211/41 |
| 4,732,291 | 3/1988 | McConnell | 220/19 |
| 4,748,993 | 6/1988 | Llewellyn | 134/166 |
| 4,830,200 | 5/1989 | Zambano et al. | 211/181 |
| 4,927,033 | 5/1990 | Patera et al. | 211/41 |
| 5,249,590 | 10/1993 | Jacobus et al. | 134/135 |
| 5,405,018 | 4/1995 | Anthrop, Jr. | 211/13 |
| 5,573,217 | 11/1996 | Garvey et al. | 248/316.7 |
| 5,580,025 | 12/1996 | Cross | 248/507 |

*Primary Examiner*—Robert W. Gibson, Jr.
*Attorney, Agent, or Firm*—Zarley, McKee, Thomte, Voorhees & Sease

[57] ABSTRACT

A rack accessory is provided for a dishwasher for holding plastic bowl lids and utensils. The accessory mounts onto one of the tines of a conventional dishwasher rack. The accessory includes a first receptacle portion with a resilient tab for frictionally engaging flat objects such as lids, and an arm defining a second receptacle portion for holding utensils and the like. An attachment member is provided on the rack accessory for removably mounting the accessory onto a rack tine. The attachment member may be in the form of a cap, a collar, or a clip.

11 Claims, 2 Drawing Sheets

DISHWASHER RACK ACCESSORY

BACKGROUND OF THE INVENTION

A dishwashing machine typically includes upper and lower racks for holding miscellaneous objects to be washed, including glasses. It is common for the glasses to be set upon a shelf portion of one of the racks at an inclined orientation so that rinse water drains from the upwardly disposed bottom of the glasses. A plurality of vertical or upstanding tines typically are positioned on the rack adjacent the glass shelf. The inclined orientation of the glasses thus creates an unused space between the glasses and the tines.

There is a need for a place in dishwashers to load thin, flat items, such as lids for plastic bowls, carving knives, and other odd-shaped utensils, such as mixing spoons and the like. The unused space between the inclined glasses and the vertical tines can be utilized for holding lids, knives, spoons, and other odd-shaped items to be washed.

Therefore, a primary objective of the present invention is the provision of a rack accessory for use in a dishwasher to hold thin, flat items and odd-shaped items to be washed.

Another objective of the present invention is the provision of a rack accessory which can be mounted upon the tines of a dishwasher rack.

A further objective of the present invention is the provision of a rack accessory which can be positioned on either the upper or lower dishwasher rack.

Another objective of the present invention is the provision of a rack accessory which can be mounted in numerous places in the dishwasher for holding items to be washed.

Still another objective of the present invention is the provision of a rack accessory which can be positioned so as to occupy normally unused space in a dishwasher.

These and other objectives will become apparent from the following description of the invention.

SUMMARY OF THE INVENTION

A rack accessory is provided for a dishwasher for holding long flat items and large and odd-shaped utensils for washing. The rack accessory includes a spring clip receptacle for receiving and holding items such as lids for plastic bowls, as well as an arm extending from the tab to hold utensils and the like. The rack accessory includes an attachment member, such as a cap, collar, or clip for mounting the accessory onto one of the upright tines of a dishwasher rack.

DETAILED DESCRIPTION OF THE DRAWING

Figure 1:
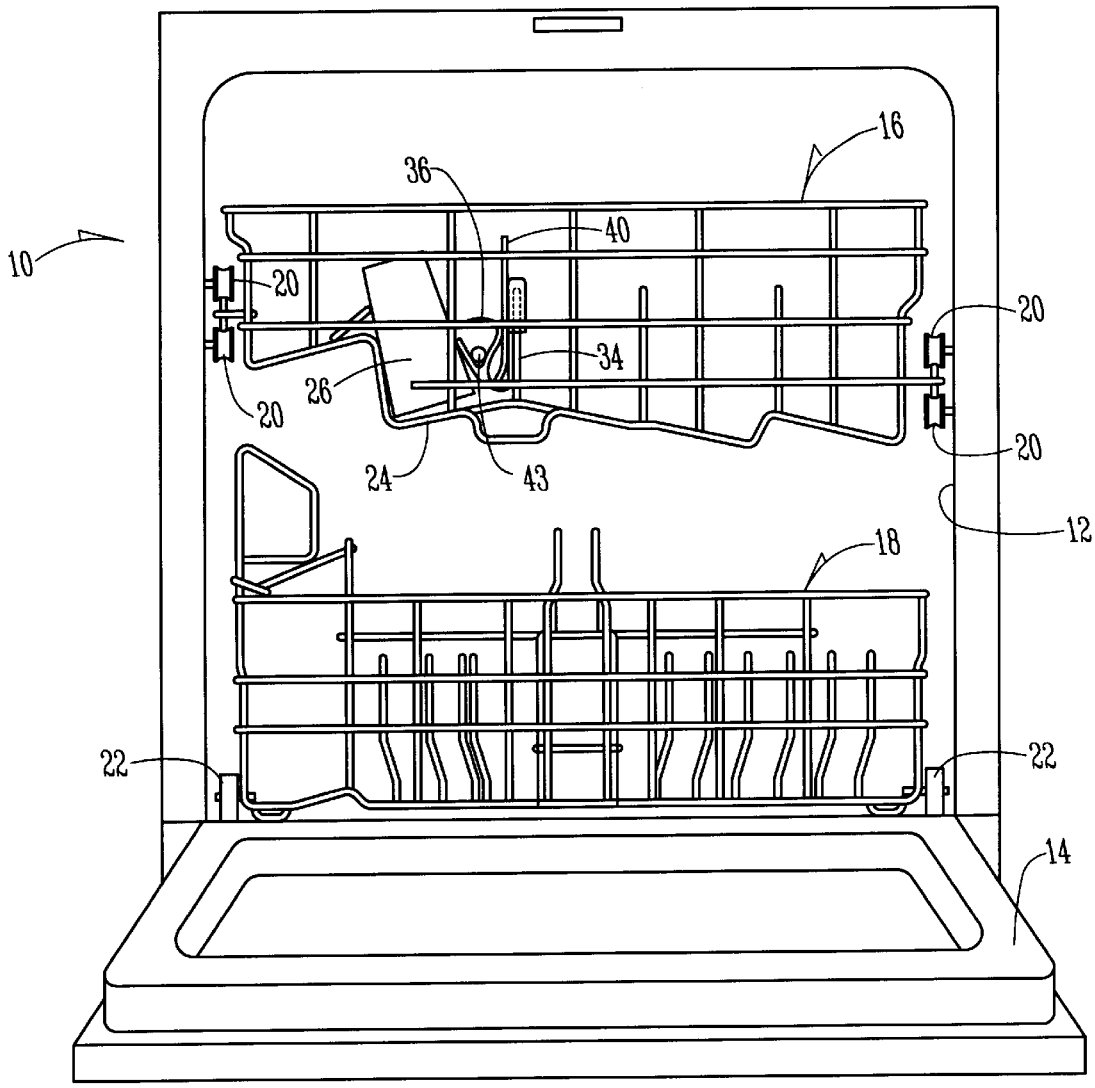
FIG. 1 is a front elevation view of a dishwasher with the door open, showing the rack accessory of the present invention.

A dishwasher is designated in FIG. 1 by the reference numeral 10. The dishwasher 10 includes a washing chamber

12 and a door 14 movable between open and closed positions to provide access to the washing chamber 12. An upper rack 16 and a lower rack 18 are mounted in the washing chamber 12. The racks, 16, 18 are mounted upon rollers 20, 22 respectively, such that the racks can be moved into and out of the washing chamber 12 to provide for easy loading and unloading of objects.

Figure 2:
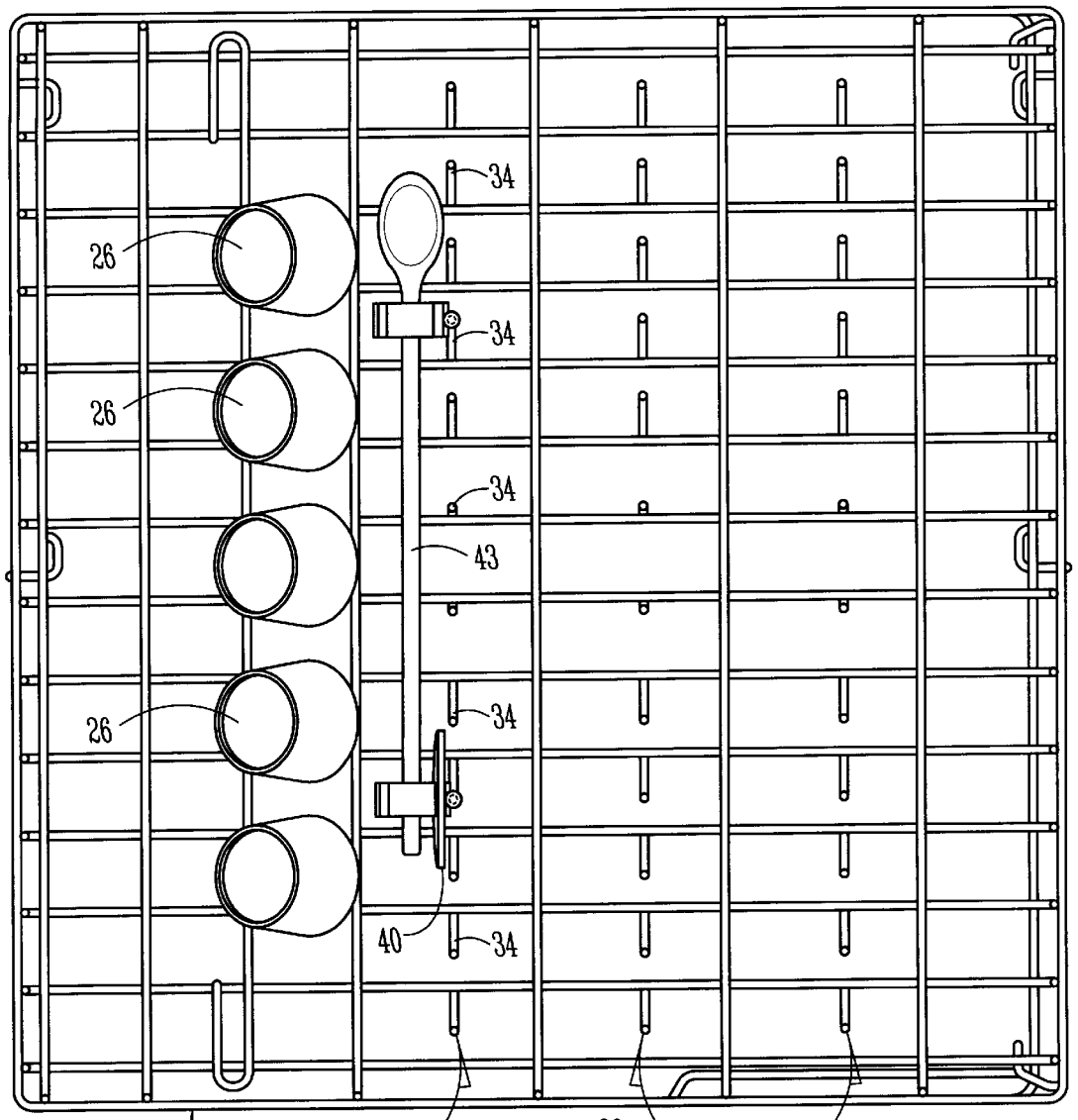
FIG. 2 is a top plan view of the upper dishwasher rack with two rack accessories of the present invention mounted on the rack tines.

As shown in FIGS. 1 and 2, the upper rack 16 includes a shelf 24 upon which glasses 26 can be set at an inclined orientation. This inclined orientation of the glasses 26 allows water to drain from the upwardly disposed bottom of the glasses. The upper rack 16 includes a plurality of rows 28, 30, and 32 of tines 34. The tines 34 are vertically disposed, such that a space exists between the inclined glasses 26 and the row 28 of tines.

The dishwasher 10, as described above, is conventional and does not constitute a part of the present invention.

Figure 4:
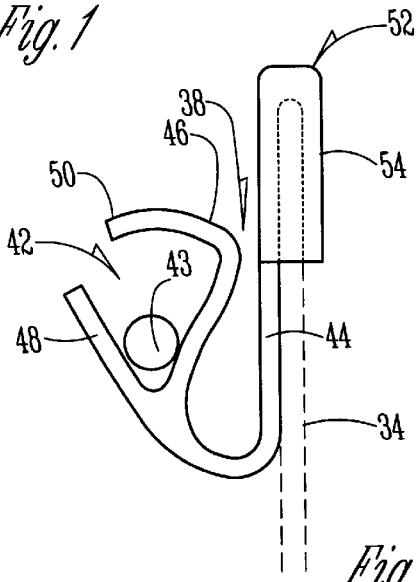
FIG. 4 is a side elevation view of a rack accessory according to the present invention.

The rack accessory of the present invention is designated in the drawings by the reference numeral 36. Preferably, the rack accessory 36 is constructed of resilient plastic. The rack accessory 36 includes a first receptacle portion 38 for holding flat objects, such as a lid 40 for a plastic bowl, and a second receptacle portion 42 for holding large or odd-shaped utensils, such as mixing spoons 43, large knives, mixing beaters, and the like. The first receptacle portion 38 is defined by a first leg 44 and a resilient spring tab 46 which frictionally engages the lid 40. An arm 48 extends angularly upwardly from the lower portion of the tab 46 so as to define the second receptacle portion 42. The upper end 50 of the tab 46 is curved over the arm 48, as best seen in FIG. 4, so as to facilitate retention of the utensil 43 in the second receptacle portion 42.

Figure 5:
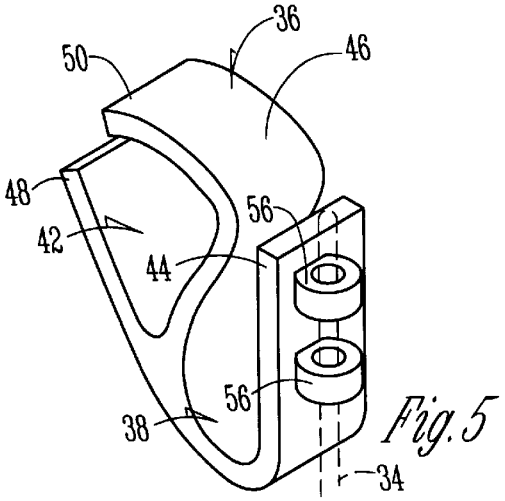
FIG. 5 is a perspective view of a first alternative embodiment of the rack accessory.
Figure 3:
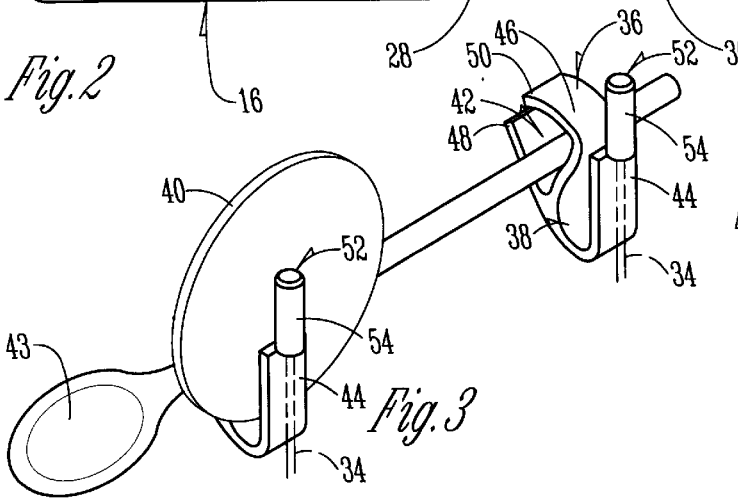
FIG. 3 is a perspective view of a pair of the rack accessories mounted on the rack tines with a utensil and a plastic bowl lid held by the accessories.
Figure 6:
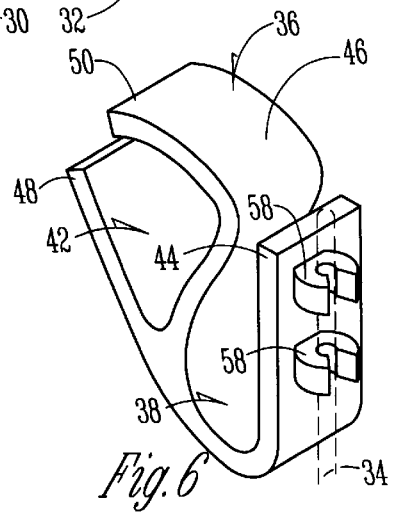
FIG. 6 is a perspective view of a second alternative embodiment of the accessory.

The rack accessory 36 includes an attachment member 52 for mounting the accessory 36 on one of the tines 34. As shown in FIGS. 3 and 4, in a first embodiment, the attachment member 52 comprises a cap 54 having an open lower end to receive the tine 34 in a closed upper end. In a second embodiment, as shown in FIG. 5, the attachment member 52 comprises one or two collars 56 through which the tine 34 is slidably received. In a third embodiment, shown in FIG. 6, the attachment member 52 comprises one or two clips 58 which frictionally engage the tine 34.

In use, each rack accessory 36 can be quickly and easily mounted upon one of the tines 34, at the discretion of the operator. Preferably the rack accessory is mounted in the otherwise unused space between the glasses 26 and the first row 28 of tines 34. It is understood that the rack accessory 36 can be mounted on any of the tines 34, on either the upper rack 16 or the lower rack 18. Pairs of spaced apart rack accessories may be used to hold long objects, such as the mixing spoon 43.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. A rack accessory for a dishwashing machine having a rack with a plurality of upstanding tines, comprising:

a receptacle having a leg and a tab defining a first portion for holding a first object to be washing; and an attachment member for removably mounting the receptacle to one of the tines.

2. The rack accessory of claim 1 wherein the attachment member includes a cap with an open lower end to fit over the tine and a closed upper end.

3. The rack accessory of claim 1 wherein the attachment member includes a collar to slidably receive the tine.

4. The rack accessory of claim 1 wherein the attachment member includes a clip to frictionally engage the tine.

5. The rack accessory of claim 1 wherein the receptacle further comprises a second portion for holding a second object to be washed.

6. The rack accessory of claim 1 wherein the tab is resilient whereby the first object is frictionally retained between the tab and the leg.

7. A rack accessory for a dishwasher having a rack for holding objects to be washed, the rack including a shelf for holding glasses in an inclined orientation and a plurality of tines extending upwardly adjacent the shelf so as to define a space between the glasses and the tines, the rack accessory comprising:

a receptacle for receiving a first object to be washed;

an attachment member on the receptacle for attaching the receptacle to one of the tines, such that the receptacle is adapted to be positioned in the space between the glasses and the tines;

the receptacle including a resilient tab for frictionally engaging t he first object; and the receptacle including an arm extending from the tab to receive a second object to be washed.

8. A rack accessory for a dishwasher having a rack for holding objects to be washed, the rack including a shelf for holding glasses in an inclined orientation and a plurality of tines extending upwardly adjacent the shelf so as to define a space between the glasses and the tines, the rack accessory comprising:

a receptacle for receiving a first object to be washed;

an attachment member on the receptacle for attaching the receptacle to one of the tines, such that the receptacle is adapted to be positioned in the space between the glasses and the tines; and the attachment member including a cap with an open lower end to fit over the tine and a closed upper end.

9. A rack accessory for a dishwasher having a rack for holding objects to be washed, the rack including a shelf for holding glasses in an inclined orientation and a plurality of tines extending upwardly adjacent the shelf so as to define a space between the glasses and the tines, the rack accessory comprising:

a receptacle for receiving a first object to be washed;

an attachment member on the receptacle for attaching the receptacle to one of the tines, such that the receptacle is adapted to be positioned in the space between the glasses and the tines; and the attachment member including a clip to frictionally engage the tine.

10. A rack accessory for a dishwasher having a rack for holding objects to be washed, the rack including a shelf for holding glasses in an inclined orientation and a plurality of tines extending upwardly adjacent the shelf so as to define a space between the glasses and the tines, the rack accessory comprising:

a receptacle for receiving a first object to be washed;

an attachment member on the receptacle for attaching the receptacle to one of the tines, such that the receptacle is adapted to be positioned in the space between the glasses and the tines; and the receptacle being defined by a leg and a resilient tab spaced closely to one another for frictionally engaging the first object between the leg and tab.

11. The rack accessory of claim 10 wherein the attachment member includes a collar to slidably receive the tine.

* * * * *